US010411345B2

(12) United States Patent
Luukanen

(10) Patent No.: US 10,411,345 B2
(45) Date of Patent: Sep. 10, 2019

(54) OPTICALLY CONTROLLED PHASE SHIFTER

(71) Applicant: Teknologian tutkimuskeskus VTT Oy, Espoo (FI)

(72) Inventor: Arttu Luukanen, Espoo (FI)

(73) Assignee: Teknologian tutkimuskeskus VTT Oy, Espoo (FI)

( * ) Notice: Subject to any disclaimer, the term of this patent is extended or adjusted under 35 U.S.C. 154(b) by 654 days.

(21) Appl. No.: 15/101,422

(22) PCT Filed: Dec. 2, 2014

(86) PCT No.: PCT/FI2014/050943

§ 371 (c)(1),
(2) Date: Jun. 3, 2016

(87) PCT Pub. No.: WO2015/082770

PCT Pub. Date: Jun. 11, 2015

(65) Prior Publication Data

US 2016/0308278 A1 Oct. 20, 2016

(30) Foreign Application Priority Data

Dec. 3, 2013 (FI) ..... 20136207

(51) Int. Cl.
*H01Q 3/26* (2006.01)
*H01Q 15/14* (2006.01)
*H01Q 19/06* (2006.01)

(52) U.S. Cl.
CPC ..... *H01Q 3/2676* (2013.01); *H01Q 15/148* (2013.01); *H01Q 19/065* (2013.01)

(58) Field of Classification Search
CPC ... H01Q 3/2676; H01Q 15/148; H01Q 19/065
See application file for complete search history.

(56) References Cited

U.S. PATENT DOCUMENTS 4,675,624 A 6/1987 Rosen et al.
5,002,350 A * 3/1991 Dragone ..... G02B 6/12011 385/24

(Continued)

FOREIGN PATENT DOCUMENTS

EP 1496372 A1 1/2005
WO WO 9326059 12/1993
WO WO2012100885 A1 8/2012

OTHER PUBLICATIONS

Chaharmir M. R. et al: Novel photonically-controlled reflectarray antenna. IEEE Trans. on Antennas and Propagation, 2006, vol. 54.

(Continued)

*Primary Examiner* — Bernarr E Gregory
*Assistant Examiner* — Fred H Mull
(74) *Attorney, Agent, or Firm* — Seppo Laine Oy

(57) ABSTRACT

To increase efficiency of optical control of phase shifting elements, arrangements comprising optical lenses are presented. The optical lenses may be arranged in reflective arrays so as to focus light from a light source on a phase shifting element, which may be placed in a feed point of an antenna, such as for example a lithographic antenna. In some embodiments, thus both optical controlling radiation and radio frequency, RF, power are concentrated in substantially the same place.

12 Claims, 3 Drawing Sheets

(56) References Cited

U.S. PATENT DOCUMENTS

| | | | | |
|---|---|---|---|---|
| 5,360,973 | A | 11/1994 | Webb | |
| 5,506,701 | A * | 4/1996 | Ichikawa | G02B 5/1885 349/15 |
| 6,417,807 | B1 | 7/2002 | Hshu et al. | |
| 6,621,459 | B2 | 9/2003 | Webb et al. | |
| 6,774,851 | B1 | 8/2004 | Cuchaci et al. | |
| 2002/0031316 | A1 * | 3/2002 | Lowry | G02B 6/06 385/120 |
| 2002/0140624 | A1 | 10/2002 | Webb et al. | |
| 2013/0162490 | A1 | 6/2013 | Blech | |
| 2013/0293436 | A1 | 11/2013 | Blech | |

OTHER PUBLICATIONS

Tamminen et al: Reflectarray for 120-GHz beam steering application: design, simulations, and measurements, Passive and active millimeter-wave imaging XV, vol. 8362 No. 1, 2012.

* cited by examiner

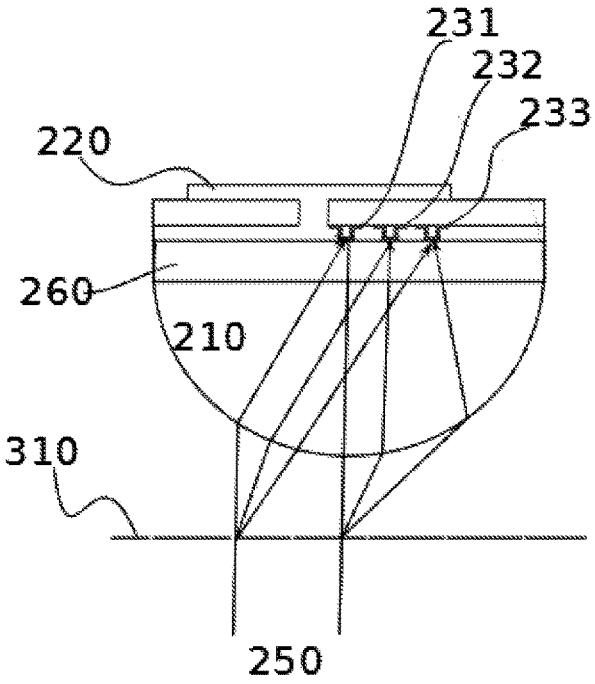
FIGURE 3A
FIGURE 3B
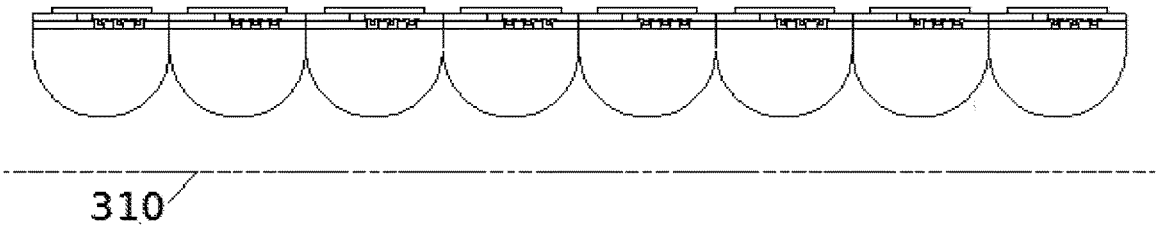

OPTICALLY CONTROLLED PHASE SHIFTER

FIELD OF INVENTION

Embodiments of the present invention relate in general to electronics, optics and/or beam controlling.

BACKGROUND OF INVENTION

An electromagnetic signal or beam may be controlled, for example, by using a lens. Lenses may be built of transparent materials such as glass or plastic, for example. In general a lens may be configured to converge or diverge a beam of light by selecting a curvature of the lens in a suitable way. To such effect, lenses may be convex or concave, for example, wherein convex lenses typically converge beams and concave lenses cause beams to diverge. Depending on the application more than one lens may be provided, such that beams of light traverse the more than one lens. Such lens assemblies may be used to process optical beams more precisely than may be achieved with single lenses, for example to control distortion.

A Fresnel lens is a special type of lens that allows more compact lenses to be produced, using up less space and material. A Fresnel lens accomplishes this by dividing the lens into annular sections separated by discontinuities. Whereas an ideal Fresnel lens would have an infinite number of annular sections, sufficiently performing Fresnel lenses may be designed with a finite number of annular sections depending on the application. In general Fresnel lenses are used in applications with less stringent performance requirements than conventional lenses. Therefore while conventional lenses are used in photography, controlling automobile headlights can be accomplished using Fresnel lenses, for example.

A further development of a Fresnel lens is a Fresnel zone plate, which relies on diffraction rather than refraction. In general amplitude-domain Fresnel zone plates may comprise radially arranged rings that alternate between opaque and transparent, whereas a phase-domain Fresnel zone plate may comprise radially arranged rings of different material thickness. A Fresnel zone plate may be arranged in a reflect array, or reflective array, configuration wherein a phase shift field is caused between an incident and reflected electromagnetic wavefront.

A Fresnel zone plate reflective array may be constructed using phase shifter elements arranged in a suitable pattern to effect a desired phase shift field to incident radiation. Selectively activating the phase shifters produces a configurable phase shift field. A selection of phase shifter type may depend on design characteristics of the system, wherein such characteristics may comprise, for example, an operating frequency of incident radiation, tolerable insertion losses, actuation speed and reliability.

SUMMARY OF THE INVENTION

According to an aspect of the present invention, there is provided an apparatus comprising an antenna element, an optical lens, and a first optoelectronic phase shifter in a feed point of the antenna element and in a focus of the optical lens.

According to another aspect of the present invention, there is provided a reflective array comprising at least one apparatus according to the aforementioned aspect, the reflective array being arranged to cause a configurable interference pattern between an incident electromagnetic field and an electromagnetic field reflected from the reflective array.

According to yet another aspect of the present invention, there is provided a beam steering apparatus comprising a reflective array according to the aforementioned aspect, wherein the beam steering apparatus further comprises a light source arranged to illuminate the reflective array.

According to yet another aspect of the present invention, there is provided a beam steering apparatus comprising a reflector array comprising a plurality of first apparatuses, each first apparatus comprising an antenna element, an optical lens and a first optoelectronic phase shifter in a feed point of the antenna element and in a focus of the optical lens, the reflector array further comprising at least one dispersive element, and a light source arranged to provide controlling radiation to the reflector array.

BRIEF DESCRIPTION OF THE DRAWINGS

FIG. 3A illustrates an example embodiment where three-bit discretization is employed.

FIG. 3B illustrates a reflector array in accordance with at least some embodiments of the invention.

DETAILED DESCRIPTION OF EXAMPLE EMBODIMENTS

Optical control of phase shifters has potential for lowering the complexity, and thus potentially also cost, of radio frequency to terahertz antennas or adaptive beam steering elements. Beam control may comprise, for example, focusing, pointing or scanning a beam. To increase efficiency of optical control of phase shifting elements, arrangements comprising optical lenses are presented. The optical lenses may be arranged in reflective arrays so as to focus light from a light source on a phase shifting element, which may be placed in a feed point of an antenna, such as for example a lithographic antenna. In some embodiments, thus both optical controlling radiation and radio frequency, RF, power are concentrated in substantially the same place.

Figure 1A:
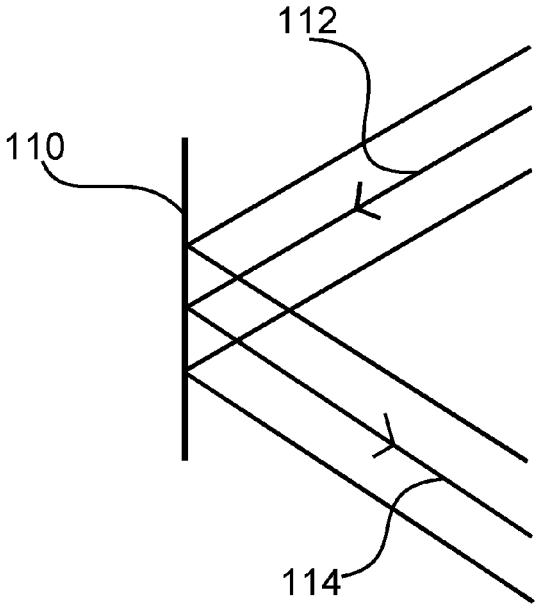
FIG. 1A illustrates operation of a reflector.

FIG. 1A illustrates operation of a reflector. Reflector 110 is here arranged to receive an incident wave 112 and to emit a reflected wave 114. The material of reflector 110 may be chosen so that it at least in part reflects, rather than absorbs, waves 112. For example where waves 112 and 114 comprise light, reflector 110 may comprise a mirror.

Reflector 110 may be built for use in an imaging or sensor application. To such end, reflector 110 may be designed to be incorporated in an apparatus wherein reflector 110 would perform a subset of tasks, or even a single task, in an overall process. For example, reflector 110 may be configured to provide a reflected and suitably phase shifted beam to an assembly comprising at least one coupling element and a detector. A detector may comprise an antenna-based detector or a charge coupled detector, CCD, comprised of a plurality of individual detector pixels.

Figure 1B:
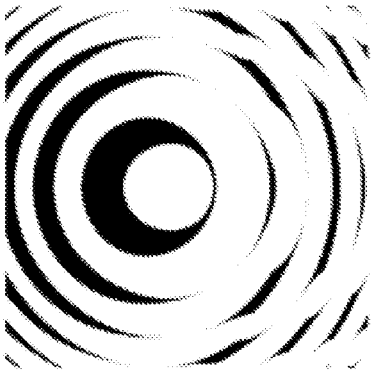
FIG. 1B illustrates an example of a binary hologram.

FIG. 1B illustrates an example of a binary, or one-bit, zone plate. The figure may correspond to a representation of a phase shift field reflector 110 is configured to cause between incident wave 112 and reflected wave 114, for example. For example, conceptually it may be thought that areas of the plate in black cause a phase shift between incident 112 and reflected 114 rays, while areas in white reflect incident 112 rays without causing a phase shift. In this way, by designing the shapes of the areas in black, a phase shift field may be configured on plate 110. Circular or elliptical zones comprised in a binary zone plate may be known as Fresnel zones. For example, the phase shift field may be configured so that constructive interference amplifies reflected wave 114 in a suitable spot to facilitate receiving information that is encoded in incident wave 112. Alternatively, the phase shift field may be configured so that when reflector 110 is installed as part of a beam steering device, aberrations caused by other elements of the beam steering device are at least in part reduced by an interference pattern between incident 112 and reflected 114 waves. Binary in this sense may mean that a phase shift is either performed or not performed in each spot, wherein for each spot where the phase shift is performed the shift is of the same magnitude.

Alternatively to a reflecting binary zone plate, a binary zone plate may be arranged to allow radiation to traverse it. Such amplitude zone plates may be referred to as transmit amplitude zone plates. In that case, the circular or elliptical zones may alternate between opaque and transparent to the radiation the zone plate is designed to process. Incident radiation will then diffract around the edges of the opaque zones to create a desired interference pattern, which may comprise a focusing effect with constructive interference, for example. For higher efficiency, phase zone plates may be more advantageous. Such phase zone plates may be referred to as transmit phase zone plates. In that case, the circular or elliptical zones may alternate between different path lengths to the radiation the zone plate is designed to process.

Figure 1C:
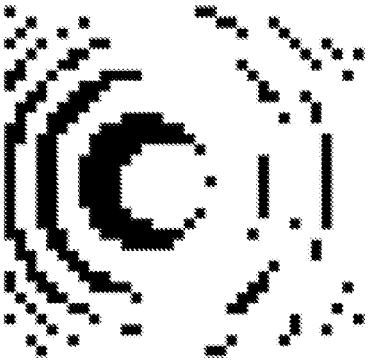
FIG. 1C illustrates an example of a discretized binary hologram.

FIG. 1C illustrates an example of a discretized version of the binary zone plate of FIG. 1B. Where the phase shift field is desired to be dynamically variable, a reflector such as reflector 110 may be furnished with programmable phase shift elements, corresponding to the black squares, or pixels, of FIG. 1C. While theoretically optimal accuracy of a resulting interference pattern may require for the shapes of the areas that cause phase shift to be continuous in shape, in practical implementations it is often the case that pixelation, as illustrated in FIG. 1C, causes a negligible or acceptable level of inaccuracy in the resulting interference field. The sizes of individual pixels, such as those of FIG. 1C, correspond to sizes of used phase shifting elements. The phase shifting elements of a suitable size may be selected in dependence of the practical application.

The phase shifting elements may comprise, for example, microelectromechanical, MEMS, phase shifters, tuneable capacitors (varactors), or liquid crystal polymer, LCP phase shifters. Alternatively, they may comprise optically controlled phase shifters. An optically controlled phase shifter may be arranged on reflector 110 so that it is enabled to receive optical energy, for example from the other side of the plate than the side that reflects incident wave 112. The optically controlled phase shifter may be arranged to introduce a phase shift when illuminated with electromagnetic radiation in a first frequency range and to not introduce a phase shift when not illuminated with the electromagnetic radiation in the first frequency range. Alternatively the optically controlled phase shifter may be arranged to introduce the phase shift only when not illuminated with the electromagnetic radiation in the first frequency range. The first frequency range may correspond, for example, to a frequency range of optical or visible light. Thus, an optoelectronic phase shifter in general may be seen to produce a phase shift in dependence of whether or not the optoelectronic phase shifter is illuminated by electromagnetic radiation in the first frequency range. An optoelectronic phase shifter may comprise a lithographically defined semiconductor connected to circuitry, such as for example to an antenna or antenna element.

The first frequency range may be substantially different from a frequency range of the incident wave 112. For example where the incident wave is comprised in a radio frequency band, the first frequency range may be comprised in the frequency band of optical light. Thus the phase shift may be switched on and off by controlling the illumination of the phase shifter. In some embodiments, the first frequency range may comprise a first radio frequency range and the incident wave 112 may be comprised in a second, different, radio frequency range.

Advantages of MEMS phase shifters include that they may be fast and incur low losses. On the other hand, MEMS phase shifters may require heterogeneously integrated high voltage drive electronics for actuation. MEMS phase shifters may be unreliable in some implementations, and their manufacture is complex which results in high cost.

Optical control of local dielectric constant in an intrinsic semiconductor may provide a high resolution in beam steering applications, but on the other hand require a high illumination power to cause sufficient change in the dielectric properties of the intrinsic semiconductor. A high illumination power needed to dynamically configure optically controlled intrinsic semiconductors may present a design challenge and also drive up power consumption of the resulting device, which in turn may necessitate heat removal which further complicates design.

Figure 2A:
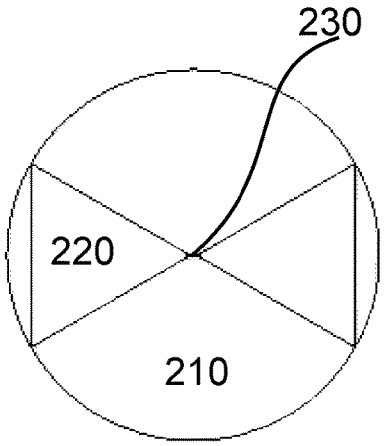
FIG. 2A illustrates a phase shifting arrangement according to at least some embodiments of the invention.

FIG. 2A illustrates a phase shifting arrangement according to at least some embodiments of the invention. The phase shifting arrangement may correspond to an individual pixel of FIG. 1C, for example. The perspective of FIG. 2A is drawn from a point of view that is above the plane of reflector looking directly toward it, the line of sight being perpendicular to the plane of the reflector. A radio frequency antenna 220, which may comprise, for example, a lithographic antenna, is comprised in the illustrated arrangement. Antenna 220 may be comprised of a metallic, electrically conductive material, for example.

Behind antenna 220 is disposed a lens, or lenslet, 210 constructed of a material suitably transparent to the controlling radiation. Lens 210 is capable of focusing the controlling radiation. The lens is arranged to focus electromagnetic radiation in the first frequency range to a phase shifter 230 disposed in a feed point of antenna 220. A feed point may correspond to an area of antenna 220 where a field strength of an incident wave is maximized. Lens 210 is arranged to focus radiation in the first frequency range on the phase shifter 230 to control, on or off, a phase shift introduced by the phase shifter. In one embodiment, a focal point of lens 210 is in the feed point of antenna 220, where also phase shifter 230 is placed. Thus in this embodiment antenna 220 is configured to focus incident wave 112 on the phase shifter and lens 210 is configured to focus the controlling radiation, in the first frequency range, on phase shifter 230, whereby the intensity of the controlling radiation is maximized on phase shifter 230 to improve the optical control of phase shifter 230. The controlling radiation may comprise, for example, electromagnetic radiation with a wavelength of about 400 nanometers.

Figure 2B:
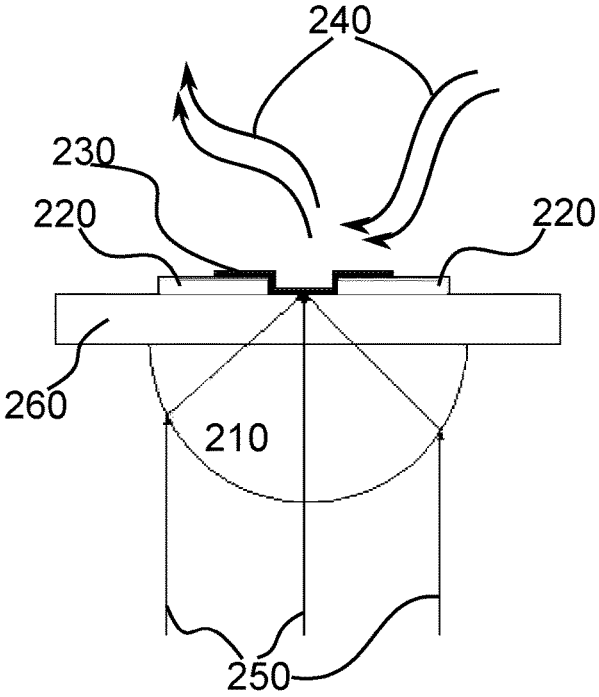
FIG. 2B illustrates another view of the phase shifting arrangement of FIG. 2A.

FIG. 2B illustrates another view of the phase shifting arrangement of FIG. 2A. The perspective of FIG. 2B is one where the line of sight is parallel to the plane of reflector 110. Here elements 210, 220 and 230 are similar to those in FIG. 2A. Lens 210 is drawn as semispherical, but other configurations are possible as long as lens 210 performs its focusing function. For example, lens 210 may be a Fresnel lens. The controlling radiation, in the first frequency range, is illustrated in FIG. 2B as 250, incident on phase shifter 230 from a different side than incident and reflected radiation 240. The incident and reflected radiation may comprise, for example, radio frequency or teraherz radiation. A substrate 260, which is substantially transparent to the first frequency range, may be arranged to provide a suitable separation between phase shifter 230 and lens 210. Substrate 260 may also provide physical substance to reflector 110, onto which antennas 220 and lenses 210 may be installed. For example, where the controlling radiation 250 is optical light, substrate 260 may comprise a transparent glass substrate. In addition to being transparent, glass can be made sufficiently rigid to provide a physical shape to reflector 110. Alternatively to glass, suitably transparent plastic may be used to build substrate 260.

In some embodiments, antenna 220 and lens 210 have have similar physical dimensions, allowing a separate lens 210 to be provided for each antenna 220. In other words, a diameter of the aperture of lens 210 may be similar to a maximum diameter of antenna 220.

Antenna 220 may be configured to reflect radiation 240 regardless of whether phase shifter 230 is configured to introduce a phase shift between incident and reflected radiation 240. The presence of absence of the phase shift may be controlled by selectively illuminating lens 210 with controlling radiation 250. The focusing effect of lens 210 allows for the intensity of controlling radiation 250 to be substantially lower when emitted from a source of the controlling radiation 250, which simplifies construction of phase shifter 230 and/or the source of controlling radiation 250.

In a reflector constructed of pixels that comprise arrangements such as those illustrated in FIG. 2, a configurable phase shift field may be achieved between incident and reflected radiation 240. By selectably illuminating the lenses 210 disposed with those phase shifters which are desired to cause a phase shift, the desired phase shift field may be achieved. For example, by using a video projector, or generally a spatial light modulator, the image of FIG. 1C may be projected onto a reflector, causing the phase shifters 230 comprised therein to be activated in accordance with the projected pattern. The projected pattern may be dynamically modified to create changes in the phase shift field and in the interference pattern between incident and reflected radiation 240.

Dynamically modifying the projected pattern may occur responsive to at least one characteristic of reflected or incident radiation. For example, in some embodiments the incident radiation changes over time, and the projected pattern, and thus the phase shift field, may be updated to at least in part to correct for changes in the incident radiation. A change in projected pattern may be effected responsive to a determination that a reflected radiation pattern degrades with respect to a pre-defined metric, for example. Alternatively, where it is known that a source emitting the incident radiation moves, for example, such motion may be accounted for by dynamically modifying the projected pattern.

A rate at which the projected pattern may be changed may depend on characteristics of the source of controlling radiation. Optoelectronic phase shifters require a non-zero, but short, time to react to a change in illumination status and updating the pattern at a rate faster than this may not be useful. The source of controlling radiation and optoelectronic phase shifters used may both be selected in dependence of the intended application, so that on the one hand the projected pattern can be updated as fast as is foreseen to be necessary and on the other hand the optoelectronic phase shifters are fast enough to be able to react to the changes in projected pattern.

A local number density of optically excited charge carriers $\Delta n$ is given by $$\frac{\Delta n}{\tau_{eff}} = \frac{I_{opt}\alpha_\gamma}{E_\gamma},$$

where $I_{opt}$ is the injection intensity (the intensity of controlling radiation 250), in watts per square meter, $W/m^2$, $\alpha_\lambda$ is an optical absorption coefficient in units 1/m, and $E_\lambda$ is the energy of photons comprised in the controlling radiation, and $\tau_{eff}$ is the effective carrier lifetime. In the flood illumination case, that is in absence of lens 210, intensity of the controlling radiation is given by $I_{opt}=P_{opt}/A$ where $P_{opt}$ is the incident illumination power and A is the area over which the illumination is distributed.

Significantly reduced controlling radiation 250 power is possible if a lens 210, for example one lens 210 for each antenna 220, is added to the system. Assuming that separation between antennas 220 is $\sim\lambda_{RF}/2$, lens 210 has a surface area of $A_L\approx\lambda_{RF}^2/4$ and assuming that the lens is diffraction limited with an f-number of roughly unity, the lens concentrates the controlling radiation 250 power to a spot with an area of $\lambda_{vis}^{2/4.}$ Thus, the lens boosts the controlling radiation intensity proportionally to $(\lambda_{RF}/\lambda_{vis})^2$. Here $\lambda_{RF}$ is the wavelength of the incident and reflected radiation 240 and $\lambda_{vis}$ is the wavelength of controlling radiation 250. As an example, assuming that incident and reflected radiation wavelength is 0.4 mm, and that the controlling radiation wavelength is 400 nm, there is a gain of 60 dB in the controlling radiation, when compared to the flood illumination case.

Methods may be employed for enhancing the quantum efficiency of absorption of controlling radiation 250 in phase shifter 230. Examples of such methods include the use of diffractive Bragg gratings and other suitable resonant optical cavity structures. An optoelectronic switch comprised as the phase shifter may be matched to the antenna impedance so that when the controlling radiation is incident on the switch it appears as a "short", and when the controlling radiation is not incident, the switch appears to be "open". Thus, for example, when incident radiation 240 is coupled to a guided wave within a microstrip circuit between antenna 220 and the optoelectronic switch 230, it undergoes a pre-determined phase shift and is re-radiated by antenna 220. The phase pattern imposed on to the incident field 240 is thus programmed onto the array by the controlling radiation 250 pattern. Fast reconfiguration is possible thanks to the rapid pattern refresh rates available from commercial off the shelf spatial light modulators, for example operating at a frequency of 30 kilohertz (kHz).

Ideally, the programmed phase shift field would replicate the desired interference pattern between the incident and reflected radiation 240 faithfully. In practice, a level of discretization may be necessary from the standpoint of straightforward implementation. Binary, or 1-bit, implementation may suffer from increased side lobes and/or poor efficiency. However, a performance difference between ideal and 3-bit discretization may be negligible, and 3-bit discretization is readily achieved in real-life implementations.

FIG. 3A illustrates an example embodiment where three-bit discretization is employed. Elements 210, 220 and 260 may be similar to those described above. Dispersive element 310 may comprise, for example, a diffraction grating configured to split controlling radiation 250 to three colours, for example red, green and blue. Where controlling radiation 250 is produced using a RGB video projector, for example, controlling radiation 250 can be arranged to comprise three colour elements in independently configurable intensities.

The colours are guided to lens 210, which in this embodiment focuses the colours separately into spatially displaced foci. In some spatial light modulators, the three different channels are by default off-set spatially, allowing for straightforward implementation in the invention. An alternative way to achieve spatial offset of different colour foci would be to place a diffraction grating in front of the array of lenses 210, which would serve to shift the optical mask image laterally on the entrance aperture plane of the lens array, resulting in a spatial shift in the foci locations. In each spatially displaced focus is disposed a phase shifter, for example phase shifter 231 in the red colour focus, phase shifter 232 in the green colour focus and phase shifter 233 in the blue colour focus. Phase shifters 231, 232 and 233 may be of similar make, or they may be configured to be most sensitive to the colour of light that they are configured to receive in an array. For example, where phase shifter 231 is in the red colour focus, it may be most sensitive to red light. Using arrangements such as the one illustrated in FIG. 3A as pixels in a reflecting array, an extent of phase shift in each pixel may be configured with an accuracy of three bits. This may be accomplished by illuminating the lens 210 of each antenna 220 with red, green, and blue light, accordingly.

FIG. 3B illustrates a reflector array in accordance with at least some embodiments of the invention. The reflector array of FIG. 3B comprises a plurality of arrangements in accordance with FIG. 3A and a diffraction grating 310 common to the plurality of arrangements according to FIG. 3A. The reflector array of FIG. 3B may provide rapidly configurable beam steering and/or manipulation.

A system operating along the lines described above may provide for a highly adaptive, high speed, high performance beam control solution, for example for imaging, telecommunications and/or sensing. Using lenses 210 to focus the controlling radiation 250 may enable a simpler and lower-powered light source to be used for the controlling. Further, reconfiguration speed may be substantially increased due to the circumvention of the trade-off in optically controlled intrinsic semiconductors where fast carrier lifetime $\tau_{eff}$ is required, driving up the required optical control intensity. Furthermore, the lower required optical irradiance allows the construction of much larger apertures that can be controlled. A lower-powered light source in turn may decrease heat management challenges and consume less power. Also, focusing the controlling radiation 250 may enable using optoelectronic phase shifters that in themselves require a lower light intensity to control them, which could make the resulting array as a whole technically simpler and cheaper to manufacture.

Although described above in terms of reflecting arrays, the principles of the present invention may be applicable also to transmit arrays wherein instead of reflecting incident radiation back, the array is configured to be traversed by the incident radiation, wherein the array would impart the configurable phase shift field to the incident radiation as it traverses the array. In a transmit array, like in reflector arrays described above, at least one optoelectronic phase shifter may be disposed in a focus of a lens and in a feed point of an antenna.

In general there is provided an apparatus, comprising an antenna element, an optical lens and a first optoelectronic phase shifter disposed in a feed point of the antenna element and in a focus of the optical lens. The feed point of the antenna element may be in the focus of the optical lens. There may be exactly one first optoelectronic phase shifter. The antenna element may comprise a lithographic antenna. The first optoelectronic phase shifter and the antenna element may be coupled via a microstrip or other suitable coupling circuit arranged in between the first optoelectronic phase shifter and the antenna element.

The apparatus may further comprise a second and, optionally, third optoelectronic phase shifter. The second and third optoelectronic phase shifters may be disposed at least in part between the optical lens and the antenna element. The first, second and/or third optoelectronic phase shifter may be disposed in the apparatus in spatially displaced foci of the lens corresponding to disparate colours of light, wherein each of one, two or three colours of light are arranged to be focused in exactly one spatially displaced focus. The second optoelectronic phase shifter and the antenna element may be coupled via a microstrip circuit or other suitable coupling circuit arranged in between the second optoelectronic phase shifter and the antenna element. The third optoelectronic phase shifter and the antenna element may be coupled via a microstrip circuit or other suitable coupling circuit arranged in between the third optoelectronic phase shifter and the antenna element.

In general there is provided a reflective array comprising at least one apparatus as described immediately above. The reflective array may be arranged to impart a configurable interference pattern between incident and reflected electromagnetic fields, the reflected field being reflected from the reflective array due to the incident field. The interference pattern may be configured by projecting an illumination pattern on the reflective array, the illumination pattern being selected in dependence of the desired interference pattern. The illumination pattern may comprise controlling radiation, for example optical light.

The reflective array may comprise two or three optoelectronic phase shifters per each antenna element to provide discretized phase shifting. Also in these cases, the reflective array may be arranged to impart a configurable interference pattern between incident and reflected electromagnetic fields, the reflected field being reflected from the reflective array due to the incident field. The interference pattern may be configured by projecting an illumination pattern on the reflective array, the illumination pattern being selected in dependence of the desired interference pattern. The illumination pattern may comprise controlling radiation, for example optical light. The illumination pattern may comprise as many colour elements as there are optoelectronic phase shifters per each antenna element.

A reflective array may comprise a dispersive element, such as for example a diffraction grating or prism, arranged to disperse controlling radiation to constituent colour elements and to guide the said colour elements to the reflective array. In detail, the constituent colour elements may be provided from said dispersive element to optical lenses arranged in said reflective array.

The reflective array may comprise an optically controlled reflective Fresnel zone plate.

In general there is provided a beam steering apparatus comprising a reflective array as described above, and further comprising a light source arranged to illuminate the reflective array.

The light source may be arranged to illuminate the dispersive element comprised in the reflective array, wherein illumination by the light source comprises provision of an illumination pattern comprised of controlling radiation to the dispersive element. The light source may comprise, for example, a video projector, such as for example a digital video projector.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A reflective array comprising at least one apparatus comprising:

an antenna element;

an optical lens, and a first optoelectronic phase shifter in a feed point of the antenna element and in a focus of the optical lens, and a second optoelectronic phase shifter disposed at least in part between the optical lens and the antenna element, the reflective array being arranged to cause a configurable interference pattern between an incident electromagnetic field and an electromagnetic field reflected from the reflective array, wherein the optical lens of the at least one apparatus comprised in the reflective array is arranged to focus a different colour of light on each of the first and the second optoelectronic phase shifter, and at least one dispersive element, the dispersive element configured to disperse light into two colours and to direct each of the two colours to the optical lens of the at least one apparatus comprised in the reflective array.

2. A reflective array according to claim 1, wherein the antenna element comprises a lithographic antenna element.

3. A reflective array according claim 1, wherein a diameter of an aperture of the optical lens is the same as a diameter of the antenna element.

4. A reflective array according to claim 1, wherein the antenna element comprises a radio frequency antenna element and the first optoelectronic phase shifter is arranged to appear as a radio frequency short when illuminated, and as a radio frequency open when not illuminated.

5. A reflective array according to claim 1, further comprising a third optoelectronic phase shifter disposed at least in part between the optical lens and the antenna element.

6. A reflective array comprising at least one apparatus according to claim 5, the reflective array being arranged to cause a configurable interference pattern between an incident electromagnetic field and an electromagnetic field reflected from the reflective array.

7. A reflective array according to claim 6, wherein the optical lens of the at least one apparatus comprised in the reflective array is arranged to focus a different colour of light on each of the first, second and third optoelectronic phase shifter comprised in the at least one apparatus.

8. A reflective array according to claim 7, wherein the reflective array comprises at least one dispersive element, the dispersive element configured to disperse light into three colours and to direct each of the three colours to the optical lens of the at least one apparatus comprised in the reflective array.

9. A reflective array according to claim 1, wherein the at least one dispersive element comprises at least one diffraction grating.

10. A reflective array according to claim 1, wherein the at least one dispersive element comprises at least one prism.

11. A beam steering apparatus comprising a reflective array comprising at least on apparatus comprising:

an antenna element;

an optical lens, and a first optoelectronic phase shifter in a feed point of the antenna element and in a focus of the optical lens, and a second optoelectronic phase shifter disposed at least in part between the optical lens and the antenna element, the reflective array being arranged to cause a configurable interference pattern between an incident electromagnetic field and an electromagnetic field reflected from the reflective array, wherein the optical lens of the at least one apparatus comprised in the reflective array is arranged to focus a different colour disperse light into two colours and to direct each of the two colours to the optical lens of the at least one apparatus comprised in the reflective array, wherein the beam steering apparatus further comprises a light source arranged to illuminate the reflective array.

12. A beam steering apparatus according to claim 11, wherein the light source comprises a video projector.

* * * * *